US007021906B2

(12) United States Patent
Chang

(10) Patent No.: US 7,021,906 B2
(45) Date of Patent: Apr. 4, 2006

(54) FAN ASSEMBLY MECHANISM

(75) Inventor: Lin-Wei Chang, Taipei (TW)

(73) Assignee: Inventec Corporation, Taipei (TW)

( * ) Notice: Subject to any disclaimer, the term of this patent is extended or adjusted under 35 U.S.C. 154(b) by 46 days.

(21) Appl. No.: 10/700,555

(22) Filed: Nov. 5, 2003

(65) Prior Publication Data

US 2004/0191089 A1 Sep. 30, 2004

(30) Foreign Application Priority Data

Mar. 31, 2003 (TW) ..... 92204993 U

(51) Int. Cl.
*F04B 17/03* (2006.01)

(52) U.S. Cl. ..... 417/360; 417/423.15

(58) Field of Classification Search ..... 417/360, 417/423.15

See application file for complete search history.

(56) References Cited

U.S. PATENT DOCUMENTS 6,817,939 B1 * 11/2004 Gan et al. ..... 454/184

* cited by examiner

*Primary Examiner*—Charles G. Freay
(74) *Attorney, Agent, or Firm*—Birch, Stewart, Kolasch & Birch, LLP

(57) ABSTRACT

A fan assembly mechanism is disclosed for mounting a fan member on a wall mounting surface of a casing, including the fan member having a flat mounting surface and a space for receiving at least one fan; at least one fastening member formed on the flat mounting surface; and an elastic fastener having its one side fixed on the fan member and at least one latching portion protruded out of the flat mounting surface. The fan assembly mechanism allows the fastening member to engage a corresponding hole on the wall mounting surface of the casing, and the latching portion to engage another hole on the casing, so as to assemble the fan member to the casing.

9 Claims, 6 Drawing Sheets

FAN ASSEMBLY MECHANISM

This Nonprovisional application claims priority under 35 U.S.C. § 119(a) on Patent Application No(s). 092204993 filed in TAIWAN on Mar. 31, 2003, the entire contents of which are hereby incorporated by reference.

FIELD OF THE INVENTION

The invention relates to fan assembly mechanisms, and particularly to an improved assembly mechanism enabling fan members to be easily mounted on and dismantled from the casing of an electronic device.

BACKGROUND OF THE INVENTION

Generally, a computer system or an electronic device has a variety of IC parts installed inside the casing thereof, such as a CPU, a power supply, and a circuit board whereon various electrical components are mounted. A great quantity of heat is generated during computer operation when electric current flows through electric circuits, which are densely placed in chips or on a circuit board. Therefore, to achieve the objective of reducing operating temperature, a fan member must be installed in a computer system or an electronic device to circulate air and radiate heat; otherwise accumulated heat inside the casing of a computer system or an electronic device during operation will raise the temperature and shorten the life-span of computer chips or other electrical components. Moreover, serious damage may be caused by burnout of computer chips or electric circuits; thereby a computer or an electronic device can immediately fail to operate thereafter.

The aforesaid conventional fan member is installed inside the casing of a computer system or an electronic device for radiating heat as shown in FIG. 1. Such conventional fan member is composed of a square-shaped frame, a motor, which is installed inside the frame for generating rotary power, and fan blades coupled with a motor transmission shaft. The motor generates power from electric current, thereby revolving the fan blades to circulate air and generate airflow, thereby exhausting the heat generated inside the casing of a computer system or an electronic device. Consequently, such fan member achieves the objective of maintaining an acceptable operating temperature inside the computer system or electronic device during operation.

The assembly method of the aforesaid conventional cooling fan is shown in FIG. 1. The said computer fan member 2 has a strip 201 installed on a lateral side of a frame 20. A rail rest 203 is correspondingly installed inside the casing of a computer system or an electronic device, enabling the strip 201 of the fan member 2 to be slid into a track 204 established between the casing and the rail rest 203. Moreover, the fan member 2 is secured to a rack 206 of the casing by a screw 205 penetrating a hole 207 on the rack 206. During the assembly process of such conventional fan member, a technician has to carefully direct the strip 201 of the fan member 2 into the track 204 of the rail rest 203 such that the strip 201 can be smoothly slid into and fixed with the rail rest 203 by the screw 205. This assembly process, however, consumes a great amount of time and labor. Another problem during assembly is that the screw could easily be dropped or lost. So, it is obvious that the assembly process of such conventional fan member 2 needs to be improved.

Another conventional fan member assembly is shown in FIG. 2. A rack 301 has a sheet metal cover 302 bent and coupled to the rack 301 inside the casing of a computer system. A space is created by the cover 302 and the rack 301 whereon the bent cover 302 is secured such that the fan member 3 can be installed inside. In that the aforesaid sheet metal cover 302 occupies large space inside a computer system, the space for placing other electrical components is reduced prior to installation of the fan. Therefore, this assembly method makes it difficult to design a system with less volume. Currently, computer product design aims at shrinking the volume and providing exquisite appearance, but such conventional fan member installation impedes creating small, attractive design and, therefore needs to be improved.

Consequently, it is greatly desired to develop an integrally formed fan assembly mechanism with the advantages of reducing the cost and space necessary for assembling components inside an electronic device while allowing rapid assembly and disassembly.

SUMMARY OF THE INVENTION

An objective of the present invention is to provide a fan assembly mechanism that can be rapidly mounted on and dismantled from a casing of an electronic device.

Another objective of the present invention is to provide an integrally formed fan assembly mechanism.

Another objective of the present invention is to provide a fan assembly mechanism that can be on the casing without using screws.

Another objective of the present invention is to provide a fan assembly mechanism that is space-effectively occupied.

To achieve the aforesaid and other objectives, the present invention provides a fan assembly mechanism for assembling at least one fan member on a wall mounting surface of a casing. The fan assembly mechanism comprises: (1) the fan member having a flat mounting surface and a space for receiving at least one fan; (2) one or more fastening members formed on the flat mounting surface, which can be engaged with corresponding holes on the wall mounting surface of the casing to assemble the fan member to the casing; and (3) an elastic fastener having one side thereof fixed on the fan member and at least one latching portion protruded out of the flat mounting surface. The elastic fastener is moved in a direction away from the wall mounting surface when an adjustable end of the elastic fastener is pressed down by a user during assembling the fan member to the casing, such that the elastic fastener generates an elastic force. When the pressure is released, the stored elastic force allows the elastic fastener to return to its original position, making the latching portion engaged with another corresponding hole on the wall mounting surface of the casing, and thus the fan member is assembled to the casing.

The elastic fastener is located in the space of the fan member, with the latching portion protruded from the flat mounting surface. At least an open trough is formed on a surface of the fan member abutting upon the flat mounting surface, such that the elastic fastener is exposed via the open trough and can be pressed by the user. The fastening members can be integrally formed with the fan member and located on edges or corners of the flat mounting surface at symmetrical positions to optimally position the fan member.

Consequently, the fan assembly mechanism formed with the fastening members and the elastic fastener according to the invention can adequately resolve the technique problems occurring in the above prior art so as to decrease the cost and occupied space for assembling components, and allow rapid mounting and dismantling of the fan member on and from the casing of an electronic device.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENT

Figure 1:
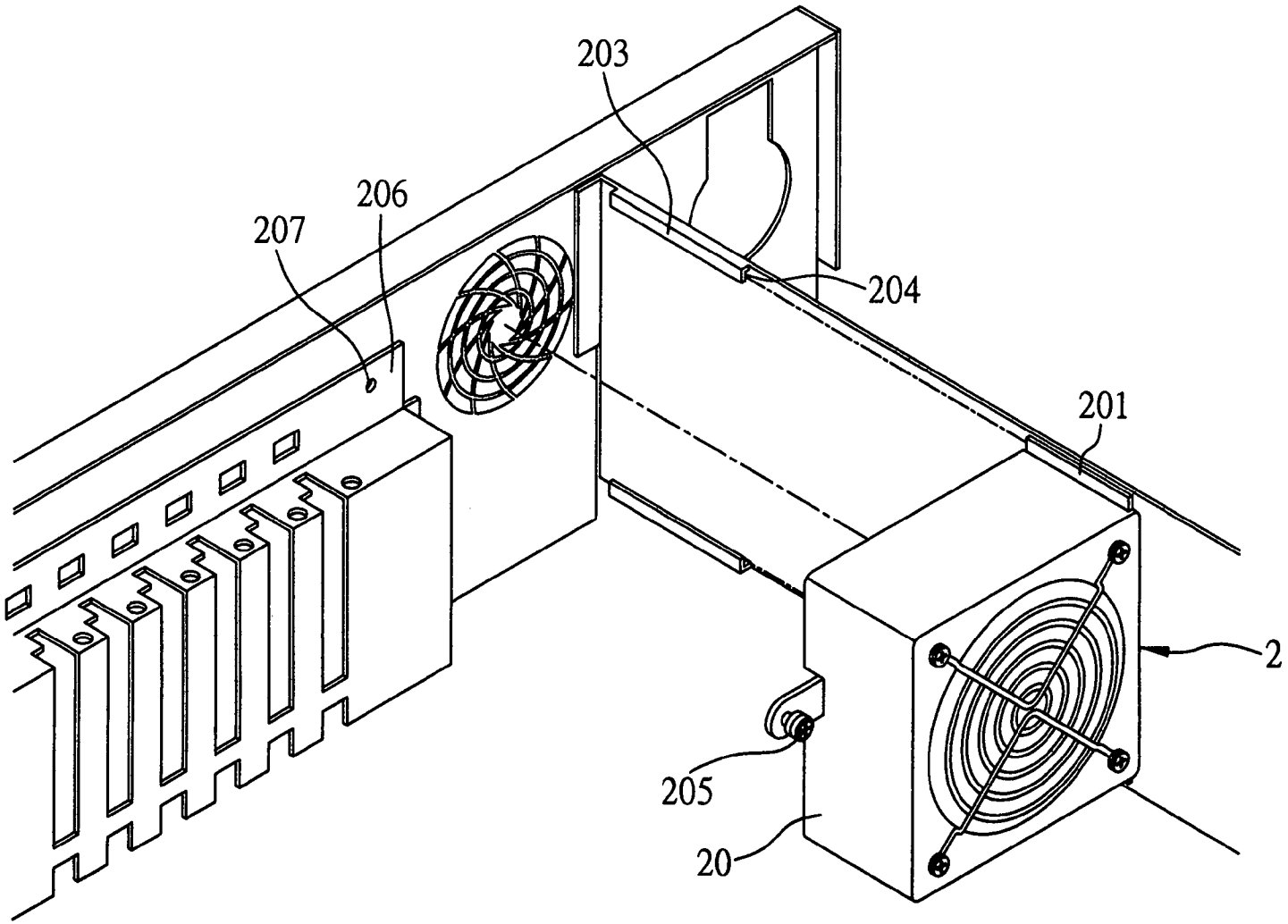
FIG. 1 (PRIOR ART)
FIG. 1 (PRIOR ART) is a perspective view of a conventional fan assembly mechanism.
Figure 2:
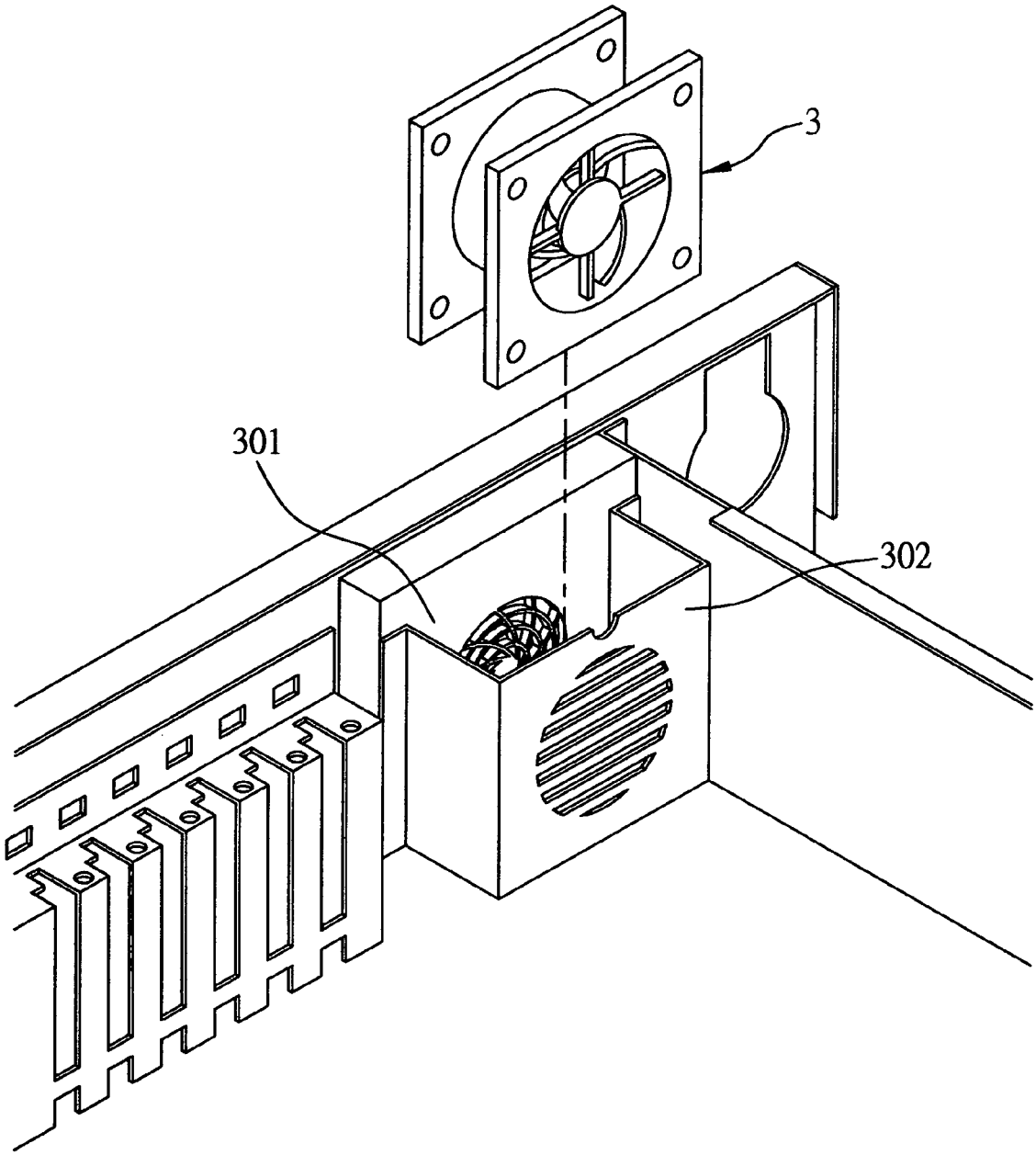
FIG. 2 (PRIOR ART)
FIG. 2 (PRIOR ART) is a perspective view of another conventional fan assembly mechanism.
Figure 3:
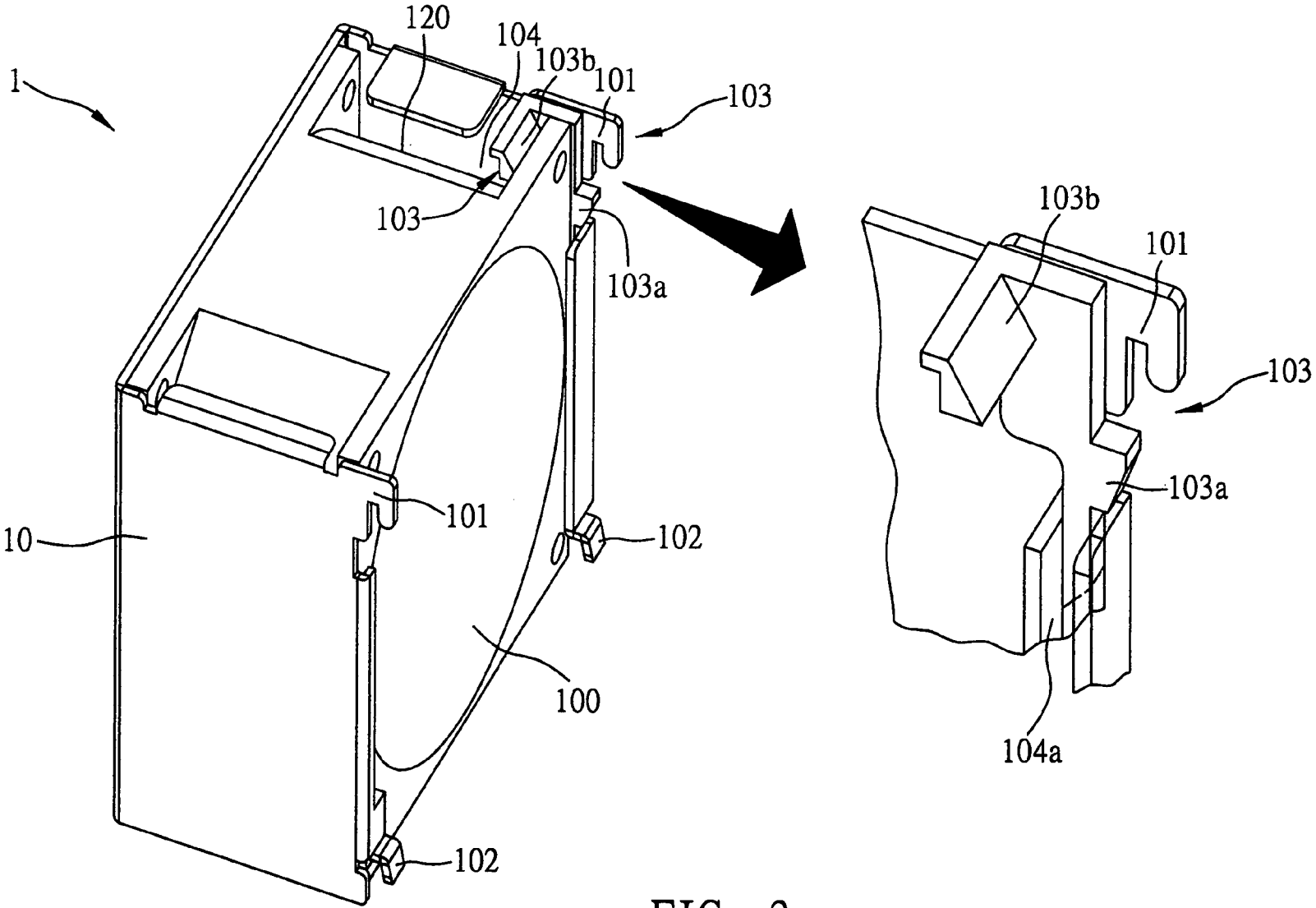
FIG. 3 is a perspective view of a fan assembly mechanism according to the invention.

A preferred embodiment of the present invention is shown in FIG. 3 wherein a fan assembly mechanism 1 comprises a fan member 10 formed with an interior space 120 enabling fan blades and a motor (not shown) to be installed for performing air circulation and heat radiation. The fan member 10 has a flat mounting surface 100 thereof affixed on a wall mounting surface 106 of the casing of an electronic device 105. The flat mounting surface 100 has four corners thereof respectively formed with fasteners, which are integrally formed with the fan member 10 and include first fastening members 101 positioned on the upper corners of the fan member 10 and corresponding second fastenings 102 positioned on the lower corners. The first fastening members 101 protrude outward and then downward from the flat mounting surface 100 forming recessed portions; while the second fastening members 102 protrude downward from the flat mounting surface 100 forming hook-like portions.

In addition, the fan assembly mechanism 1 comprises an elastic fastener 103, which is installed inside the space 120 and integrally formed with the casing of the fan member 10 using the same plastic material. The elastic fastener 103 has one side thereof placed into a narrow opening 104*a* on a lateral side of the fan member 10 and has the adjustable end thereof formed with an inclined and depressed surface 103*b* with a perpendicular recess. Meanwhile, the elastic fastener 103 has a latching portion 103*a* protruding from the flat mounting surface 1*q*00; whereas the other portions thereof are contained inside the space 120. The elastic fastener 103 is movable inside the space 120 in the direction away from the wall mounting surface 106 using its immovable end as fulcrum, when the inclined and depressed surface 103*b* is under pressure. The elastic fastener 103 is sequentially returned to its original position by dint of an elastic force when the pressure is released, thereby enabling the latching portion 103*a* to again protrude out of the flat mounting surface 100. The fan member 10 has troughs 104 respectively on both sides of its top surface, which creates a room inside the space 120 enabling the elastic fastener 103 to be moved and enabling a user to directly put pressure on the elastic fastener 103 using the inclined and depressed surface 103*b*.

Figure 4:
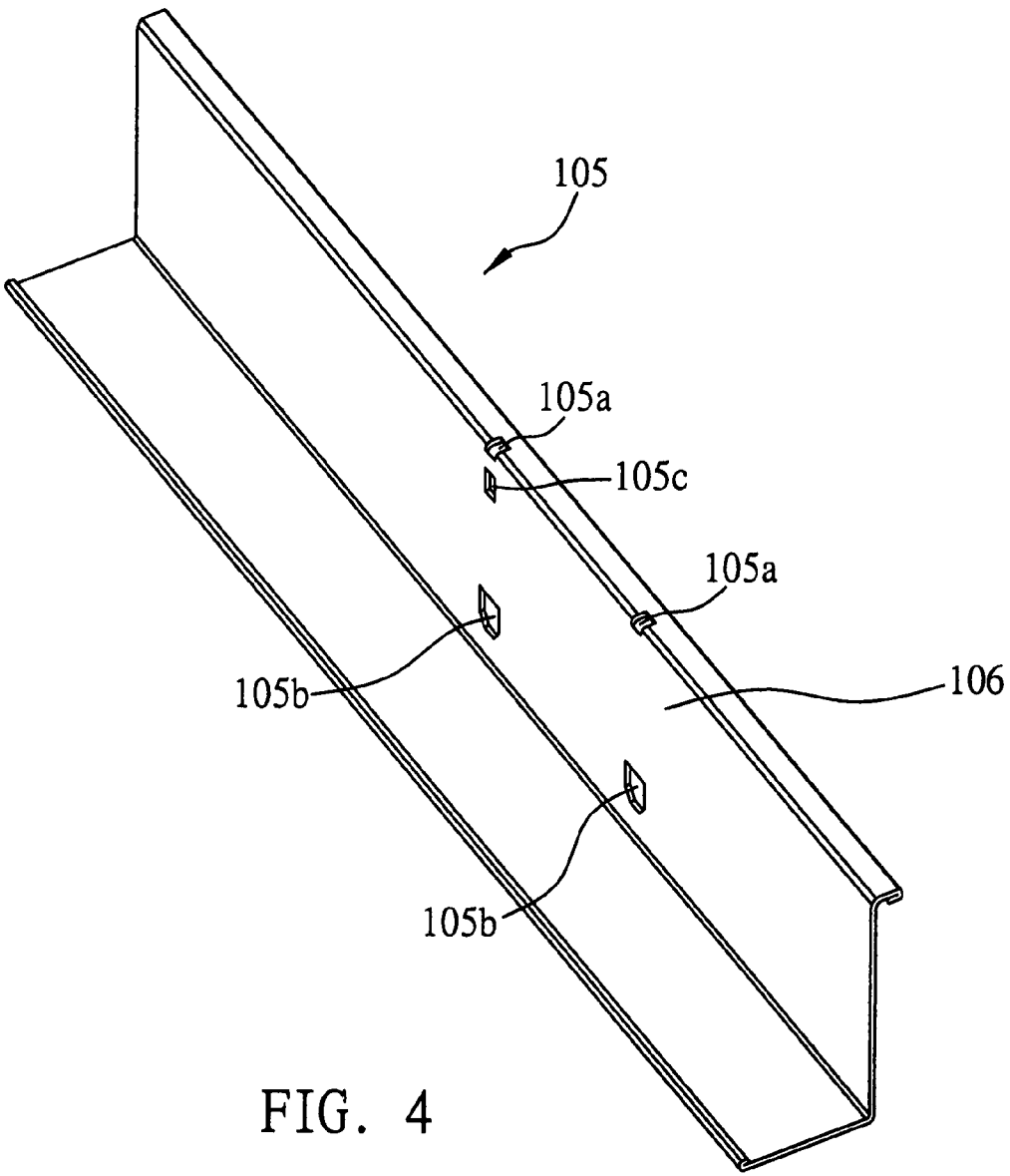
FIG. 4 is a perspective view of a casing used with the fan assembly mechanism according to the invention.

Therefore, the fan member 10 can be attached to the casing 105 of an electronic device, such as a computer system, by dint of the fan assembly mechanism 1. As shown in FIG. 4, the wall mounting surface 106 of the casing 105 enables the fan member 10 to be mounted thereon by adjoining it with the flat mounting surface 100. Moreover, the wall mounting surface 106 has holes formed thereon, including first holes 105*a* and second holes 105*b*, wherein the first holes 105*a* correspond to the first fastening members 101 and the second holes 105*b* correspond to the second fastening members 102. The openings of the first holes 105*a* are slightly plumbed with the wall mounting surface 106, thereby enabling the first fastening members 101 to be secured; whereas the second holes 105*b* are opened on the wall mounting surface 106 enabling the second fastening members 102 to be received therein. In addition, the position on the wall mounting surface 106 of the casing 105 corresponding to that of the latching portion 103*a* on the elastic fastener 103 has a hole 105*c*, whose size can be exactly matched to the latching portion 103*a* of the elastic fastener protruding from the flat mounting surface 100, enabling the latching portion 103*a* to be wedged inside the hole 105*c* and enabling the fan member 10 to be fixed on the casing 106.

Therefore, when a user installs the fan member 10 on the casing 105 using the fan assembly mechanism 1, the first fastening members 101 of the fan member 10 can be tightly wedged into the first holes 105*a* of the wall mounting surface 106 on the casing, thereby the fan member 10 is positioned on the mounting position of the casing 105. Sequentially, the user can place the second fastening members 102 of the fan member 10 into the second holes 105*b* on the wall mounting surface 106, thereby wedging the four corners on the flat mounting surface 100 of the fan member 10 into the mounting positions. The fan member 10 is well positioned at this stage, but awaits being securely hooked in as the fan member is not fully mounted and might fall down under pressure or during the moving process. Therefore, the user can further press on the inclined and depressed surface 103*b* of the elastic fastener 103 of the fan assembly mechanism 1 through the open trough 104; the direction of pressure shall follow the same direction of the inclined and depressed surface 103*b*, thereby enabling the elastic fastener inside the space 120 to be moved in the direction away from the wall mounting surface 106, thereby the elastic fastener 103 stores elastic force resulting from the movement under pressure. The latching portion 103*a* protruded out of the flat mounting surface 100 is then moved backwards and enters inside the space 120. Therefore, when the pressure on the elastic fastener 103 is released, the elastic fastener 103 returns back to its original position due to its own elastic force, thereby enabling the latching portion 103*a* to be returned back to the position of protruding out of the flat mounting surface 100 of the fan member 10. Consequently, the fan member 10 is positioned on the wall mounting surface 106 of the casing 105 by means of the first fastening members 101 and the second fastening members 102, so that the latching portion 103*a* on return back to its original position can be wedged into the corresponding hole 105*c* on the wall mounting surface 106, thereby the fan member 10 is securely fixed by five mechanisms, which are both of the first fastening members 101, both of the second fastening members 102, and the latching portion 103*a* of the elastic fastener 103.

The aforesaid assembly process is an easy and labor-saving method; meanwhile, the assembly has the advantage of the precise positioning without deviation, wherein it can be implemented by simply fastening and hooking in the fan member on the casing. The invention is more convenient compared to the conventional technique. Moreover, the integrated design of the invention avoids the possibility of lost parts, e.g., screws, etc., and does not exhibit the possibility of fasteners separating into pieces due to joint material and centralized stress. In addition, the operation of dismantling the fan member 10 employs the same steps as that of assembling, but in reverse order.

Figure 5:
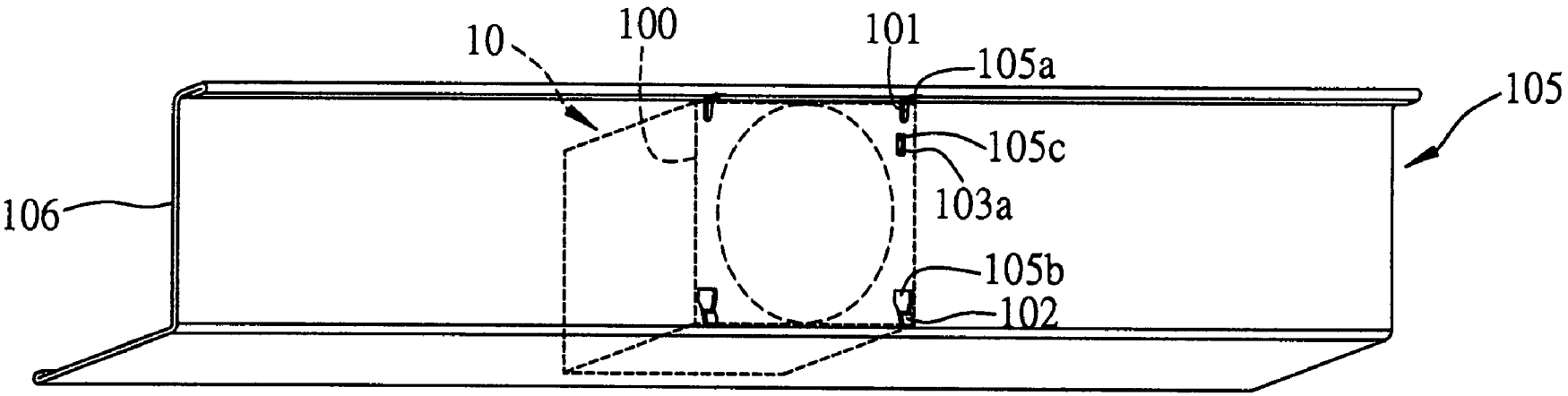
FIG. 5 is a perspective view showing the assembly of the casing and a fan member of the fan assembly mechanism according to the invention.

FIG. 5 is the perspective view showing the completed assembly of the fan member 10 on the casing 105 from the back of FIG. 4, i. e., a perspective view showing the reverse side of the wall mounting surface 106 from the backside of the casing 105. It clearly shows the fan member 10 positioned on the wall mounting surface 106 by the first fastening members 101, the second fastening members 102 and the latching portion 103*a* of the elastic fastener 103.

Figure 6:
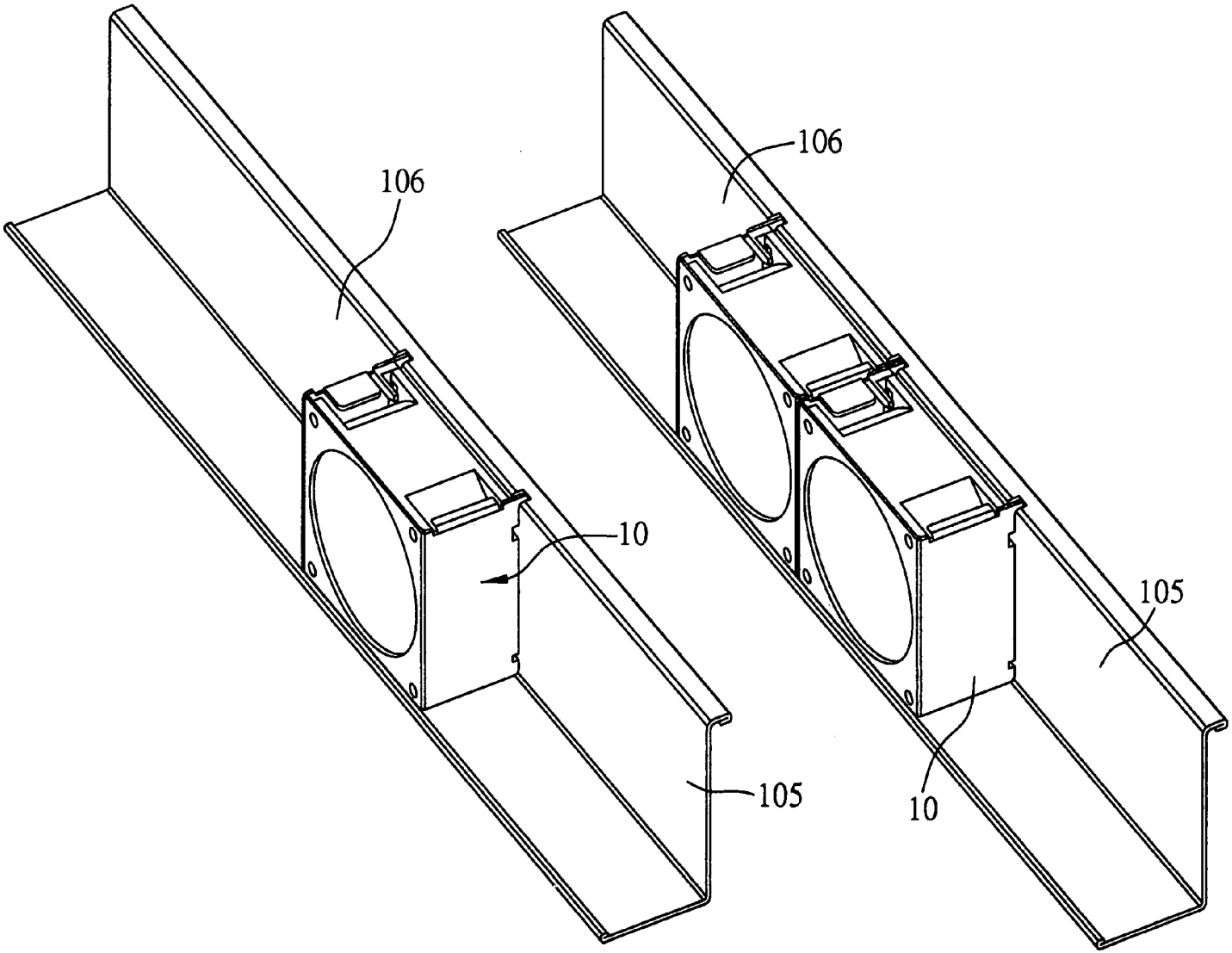
FIG. 6 is a perspective view showing the assembly of the casing and a plurality of the fan members according to the present invention.

FIG. 6 is the perspective view showing multiple (two) fan members 10 on the same casing 105 according to the present invention. The invention enables the wall mounting surface 106 on the casing 105 to be formed with a plurality of sets of mounting holes for installing a plurality of fan members 10 thereon according to the user requirement. Each fan member 10 can be coupled with its adjacent fan member(s), all of which are positioned on pre-set positions, each position employing the first fastening members, the second fastening member and the latching portion of elastic fastener designed by the invention to achieve said assembling and dismantling effects. Meanwhile, the deployment of those fan members can minimize the distance between adjacent fan members 10. In that each lateral side of a fan member 10 is a plane surface, the volume of the fan members 10 inside the casing of a computer system or an electronic device can be minimized; in addition, the number of fan members can be flexibly adjusted according to the amount of heat generated inside the casing during operation. The invention, therefore, has the advantages of convenience and flexibility for easily assembling or dismantling fan members, as well as the benefit of being able to easily increase or decrease the number of fan members inside the casing.

Therefore, it can be concluded that the fan assembly mechanism of the present invention enables fan members to be easily and rapidly mounted and dismantled; moreover, this kind of integrated design without depending on screws further reduces assembly costs and the number of parts; meanwhile, it minimizes the space occupied by fan members installed inside the casing.

It is to be understood that the embodiment described herein is merely illustrative of the principles of the invention and that a wide variety of modifications thereto may be effected by persons skilled in the art without departing from the spirit and scope of the invention as set forth in the following claims, such as changing the number of and the positions of the fastening members and elastic fasteners.

What is claimed is:

1. A fan assembly mechanism for assembling at least one fan member on a wall mounting surface of a casing, comprising:

a fan member having a flat mounting surface and a space for receiving at least one fan;

at least one fastening member formed on the flat mounting surface, which is engaged with a corresponding hole on the wall mounting surface of the casing to assemble the fan member to the casing; and an elastic fastener having one side thereof fixed on the fan member, and comprising at least one latching portion protruded out of the flat mounting surface, wherein the elastic fastener has an adjustable end susceptible to pressure so as to allow the elastic fastener to move in a direction away from the wall mounting surface of the casing and generate an elastic force, and the elastic fastener returns to its original position by the elastic force at the time the pressure is released such that the latching portion of the elastic fastener is engaged with another corresponding hole on the wall mounting surface of the casing to assemble the fan member to the casing.

2. The fan assembly mechanism of claim 1, wherein the adjustable end of the elastic fastener has an inclined and depressed surface where the pressure is exerted.

3. The fan assembly mechanism of claim 1, wherein the elastic fastener is received in the space of the fan member, with the latching portion protruded out of the flat mounting surface.

4. The fan assembly mechanism of claim 3, wherein at least one open trough is formed on a surface of the fan member adjacent to the flat mounting surface, allowing the elastic fastener to be exposed via the open trough and subject to the pressure.

5. The fan assembly mechanism of claim 1, wherein the elastic fastener is made of a plastic material.

6. The fan assembly mechanism of claim 1, wherein the fastening member is integrally formed with the fan member.

7. The fan assembly mechanism of claim 1, wherein the fastening member is formed on a corner of the flat mounting surface.

8. The fan assembly mechanism of claim 1, wherein the fastening member is formed on an edge of the flat mounting surface.

9. The fan assembly mechanism of claim 1, wherein the casing is an electronic device casing.

* * * * *